US006058528A

United States Patent [19]

Yang

[11] Patent Number: 6,058,528

[45] Date of Patent: May 9, 2000

[54] PLAYPEN WITH DETACHABLE COT

[76] Inventor: Chih-Huang Yang, 7F-1, No. 9-7, Sec.2, Chung-Kang Rd., Taichung City, Taiwan

[21] Appl. No.: 09/407,407

[22] Filed: Sep. 29, 1999

Related U.S. Application Data

[63] Continuation-in-part of application No. 09/264,662, Mar. 8, 1999.

[51] Int. Cl.[7] ..... A47D 7/00

[52] U.S. Cl. ..... 5/93.1; 5/93.2; 5/99.1

[58] Field of Search ..... 5/93.1, 98.1, 99.1, 5/93.2, 94, 95, 98.3

[56] References Cited

U.S. PATENT DOCUMENTS

| | | | |
|---|---|---|---|
| 3,848,277 | 11/1974 | Regiutti | 5/93.1 |
| 5,163,191 | 11/1992 | Chan | 5/99.1 |
| 5,339,470 | 8/1994 | Smamie | 5/98.1 |
| 5,778,465 | 7/1998 | Myers | 5/99.1 |
| 5,867,850 | 2/1999 | Mariol | 5/93.2 |
| 5,963,996 | 10/1999 | Hsia | 5/93.1 |

*Primary Examiner*—Alexander Grosz
*Attorney, Agent, or Firm*—Brinks Hofer Gilson & Lione

[57] ABSTRACT

A playpen includes a looped upper frame disposed above and spaced apart from a looped lower frame in a vertical direction. A plurality of vertical posts bridge the upper and lower frames. A cot has a bottom wall and a surrounding wall that is connected to a periphery of the bottom wall and that extends upwardly from the bottom wall. The surrounding wall has a length in the vertical direction which is shorter than a distance between the upper and lower frames in the vertical direction. The surrounding wall further has a distal top portion that engages removably the upper frame for suspending the cot thereon such that the bottom wall is disposed above the lower frame. A releasable fastening unit is provided on the distal top portion of the surrounding wall and the vertical posts for fastening releasably the cot on the vertical posts.

10 Claims, 4 Drawing Sheets

PLAYPEN WITH DETACHABLE COT

CROSS-REFERENCE TO RELATED APPLICATION

This application is a Continuation-in-Part of co-pending U.S. patent application Ser. No. 09/264,662, which was filed on Mar. 8, 1999.

FIELD OF THE INVENTION

The invention relates to a playpen, more particularly to a playpen with a detachable cot.

BACKGROUND OF THE INVENTION

Playpens of foldable and non-foldable types are known in the art. Most non-foldable playpens are bulky and occupy relatively large storage spaces, and are therefore hardly appreciated and liked by city-dwellers. Foldable playpens generally occupy smaller storage spaces and are therefore preferred by the city-dwellers. A plurality of joints and couplers are employed to interconnect the adjoining ends of the frame sections which, in turn, confine looped frames for forming a playpen. Locking devices are employed to prevent folding of the adjoining frame sections. However, accidental actuation of the locking devices may occur, thereby resulting in folding of the frame sections relative to each other, which action may injure a child playing in the foldable playpen.

In co-pending U.S. patent application Ser. No. 09/264,662 by the applicant, there is disclosed a playpen that includes a looped lower frame, a looped upper frame, a plurality of couplers, and a plurality of vertical posts. The looped lower frame includes a plurality of interconnected lower frame sections having adjoining ends. The looped upper frame is disposed above the looped lower frame, and includes a plurality of upper frame sections having adjoining ends. The couplers interconnect the adjoining ends of the upper and lower frame sections. Each of the couplers includes a tubular portion which has two opposite open ends for insertion of a pair of the adjoining ends of the upper and lower frame sections, and a socket portion which projects from the tubular portion between the open ends and which has a socket hole. The vertical posts bridge the upper and lower frames and are connected to the couplers. Each of the vertical posts has two ends respectively supported by the socket portion a corresponding one of the couplers in the upper frame and the socket portion of a corresponding one of the couplers in the lower frame.

It is noted that the vertical posts of the playpen of the aforesaid co-pending patent application are made to be as long as possible so as to be suitable for use by taller children as well. However, the longer vertical posts will made it inconvenient to put and take a small child in the playpen.

SUMMARY OF THE INVENTION

Therefore, the object of this invention is to provide a playpen which has a detachable cot for accommodating a small child therein.

Accordingly, the playpen of this invention includes a looped lower frame, a looped upper frame, a plurality of vertical posts, a cot, and a releasable fastening unit. The looped upper frame is disposed above and is spaced apart from the lower frame in a vertical direction. The vertical posts bridge the upper and lower frames. The cot has a bottom wall and a surrounding wall that is connected to a periphery of the bottom wall and that extends upwardly from the bottom wall. The surrounding wall has a length in the vertical direction which is shorter than a distance between the upper and lower frames in the vertical direction. The surrounding wall further has a distal top portion that engages removably the upper frame for suspending the cot thereon such that the bottom wall is disposed above the lower frame. The releasable fastening unit is provided on the distal top portion of the surrounding wall and the vertical posts for fastening releasably the cot on the vertical posts.

Preferably, the distal top portion of the surrounding wall is formed from a fabric material, and has an outwardly folded section defining a looped receiving groove that opens downward for receiving removably the upper frame therein.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENT

Figure 1:
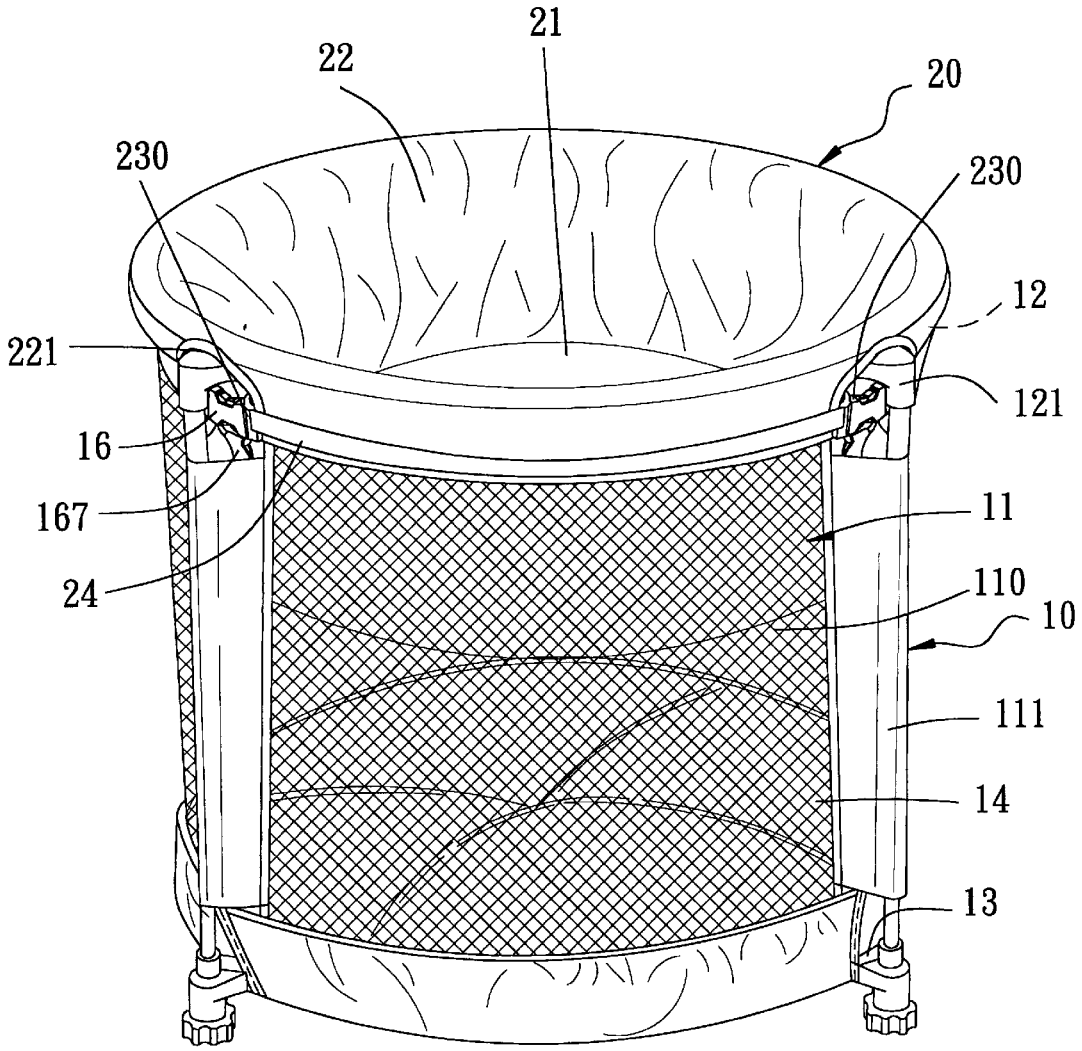
FIG. 1 is a perspective view of a preferred embodiment of a playpen of this invention.
Figure 2:
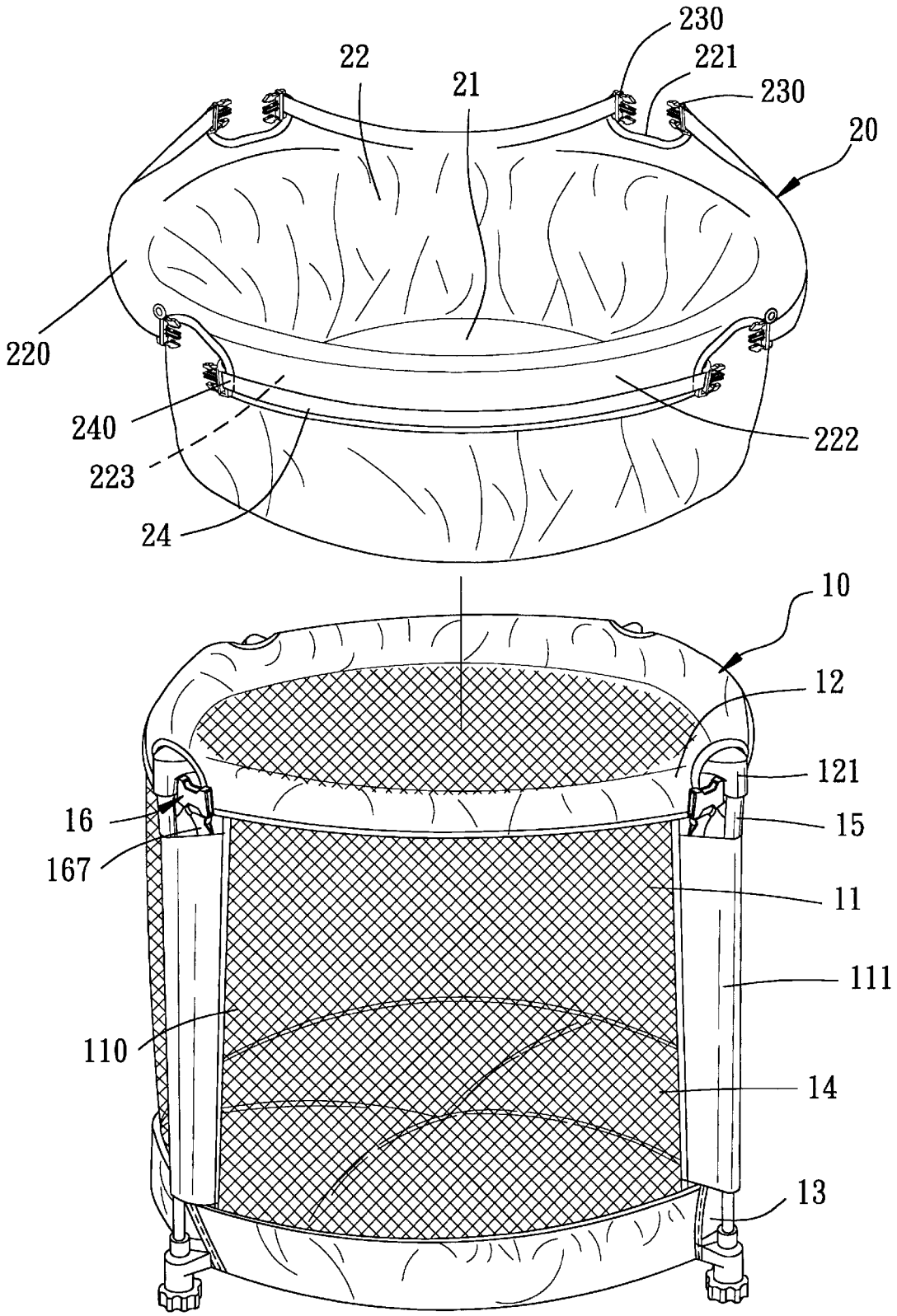
FIG. 2 is a partly exploded view of the preferred embodiment.
Figure 3:
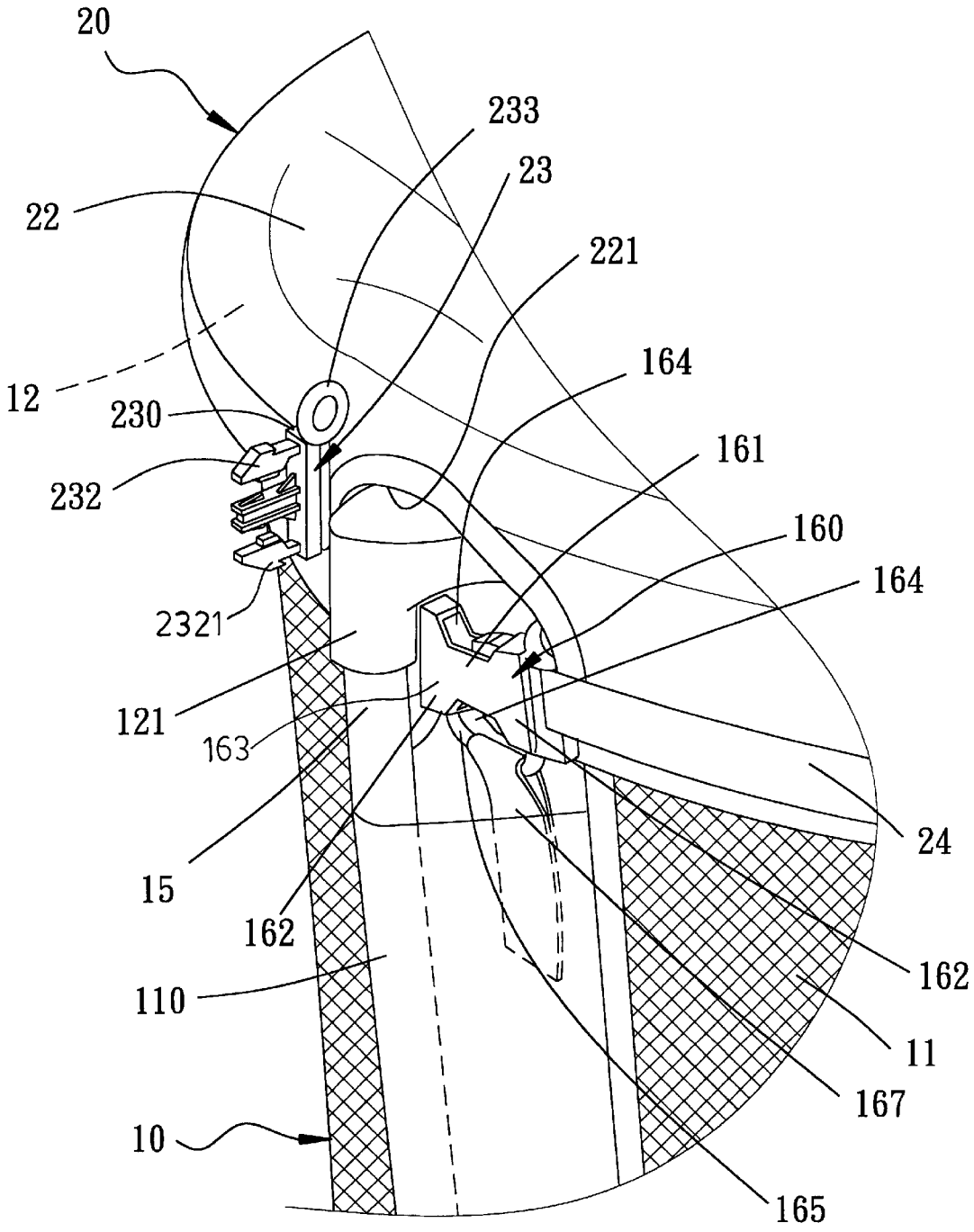
FIG. 3 is an enlarged fragmentary perspective view of the preferred embodiment, illustrating how a releasable fastening unit fastens a cot on a vertical post.

Referring to FIGS. 1, 2, and 3, the preferred embodiment of a playpen according to this invention is shown to include a looped lower frame 13, a looped upper frame 12, a plurality of vertical posts 15, a cot 20, and a releasable fastening unit.

As illustrated, the upper frame member 12 is disposed above and is spaced apart from the lower frame 13 in a vertical direction.

The vertical posts 15 bridge the upper and lower frames 12, 13.

The cot 20 has a bottom wall 21 made from a cushioning material and a surrounding wall 22 formed from a fabric material. The surrounding wall 22 is connected to a periphery of the bottom wall 21 and extends upwardly from the bottom wall 21. The surrounding wall 22 has a length in the vertical direction which is shorter than a distance between the upper and lower frames 12, 13 in the vertical direction. The surrounding wall 22 further has a distal top portion 220 that engages removably the upper frame 12 for suspending the cot 20 thereon, as best shown in FIG. 1, such that the bottom wall 21 is disposed above the lower frame 13.

The releasable fastening unit, including complementary male and female fastener sets (23,16), is provided on the distal top portion 220 of the surrounding wall 22 and the vertical posts 15 for fastening releasably the cot 20 on the vertical posts 15.

In the preferred embodiment, the distal top portion 220 of the surrounding wall 22 has an outwardly folded section 222 defining a looped receiving groove 223 that opens downward for receiving removably the upper frame 12 therein. The outwardly folded section 222 is provided with a plurality of notches 221 that are registered with the vertical posts 15. The female fastener set 16 is secured to the vertical posts 15, while the male fastener set 23 is secured to the outwardly folded section 222 and extends into the notches 221 such that each fastener 160 of the female fastener set 16 is disposed between a pair of fasteners 230 of the male fastener set 23.

Each of the fasteners 230, 160 of the male and female fastener sets (23,16) is formed with a coupling ring (233, 165). Each of the vertical posts 15 is provided with an anchoring strap 167 that is connected to the coupling ring 165 of a respective one of the fasteners 160 of the female fastener set 16. Each of the fasteners 160 of the female fastener set 16 includes a hollow fastener body 161 with two opposite open insert ends 162, and a confining wall 163 that is formed with opposite engaging slots 164. Each of the fasteners 230 of the male fastener set 23 has an insert portion 232 that is extended into the hollow fastener body 161 of a corresponding one of the fasteners 160 of the female fastener set 16 via the open insert end 162 and that is formed with resilient projections 2321 for engaging releasably the engaging slots 164 in the hollow fastener body 161 of the corresponding one of the fasteners 160 of the female fastener set 16.

The cot 20 further has a plurality of elastic bands 24. Each of the elastic bands 24 is secured to the outwardly folded section 222 and extends between an adjacent pair of the notches 221. Each of the elastic bands 24 has opposite ends 240 connected to a respective two of the fasteners 230 of the male fastener set 23 at the coupling rings 233 such that the elastic bands 24 ensure tight engagement between the distal top portion 220 of the surrounding wall 22 and the upper frame 12 when the male and female fastener sets (23,16) are interengaged.

Figure 4:
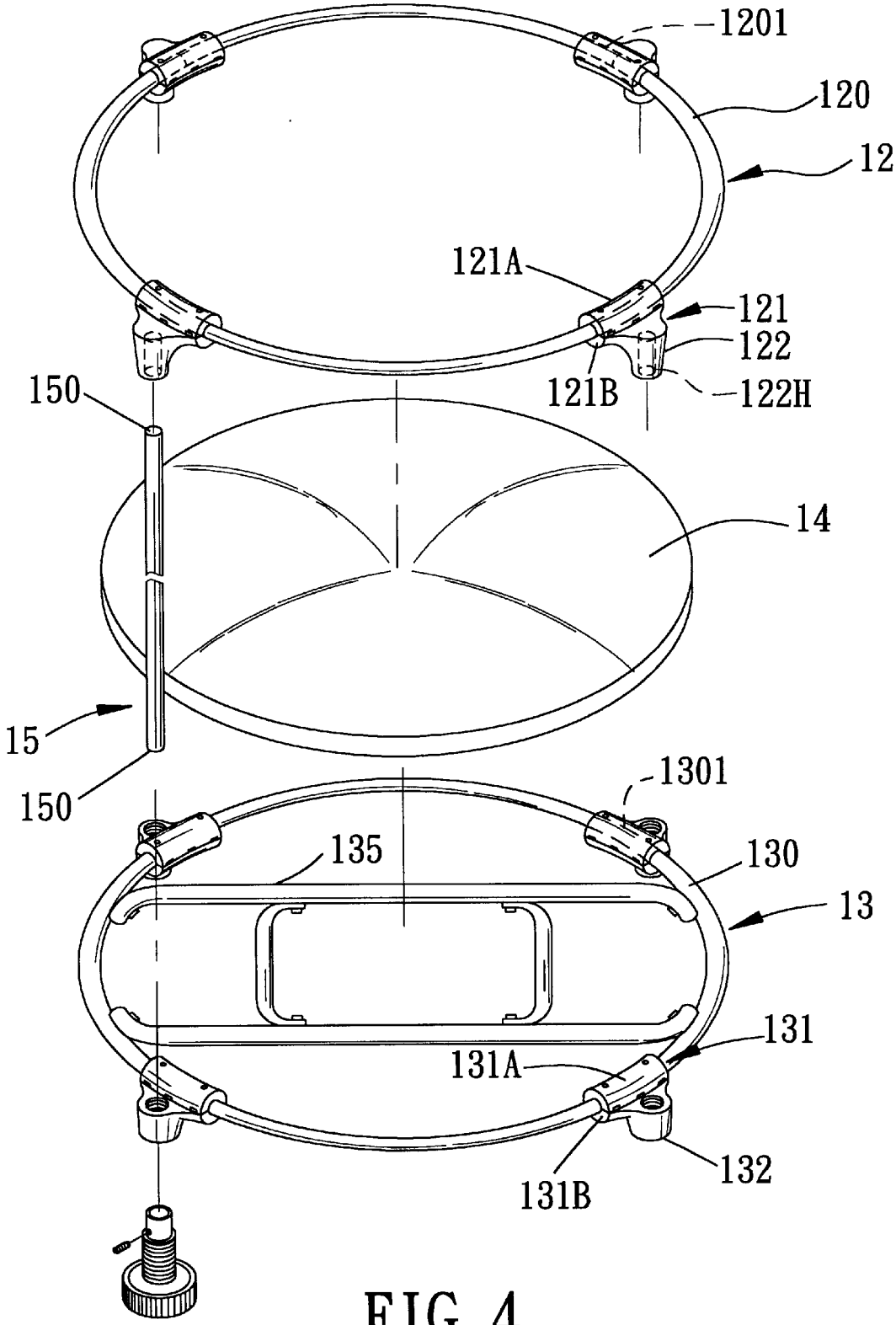
FIG. 4 is an exploded view of the preferred embodiment, wherein the cot and an enclosure are removed for the sake of clarity.

Referring to FIG. 4, the upper and lower frames (12,13) are circular and are formed as arc-shaped tubes. Each of the upper and lower frames (12,13) includes a plurality of interconnected lower frame sections (120,130) having adjoining ends (1201,1301). A plurality of arch-shaped couplers (121,131) are employed to interconnect the adjoining ends (1201,1301) of the upper and lower frame sections (120,130) of the upper and lower frames (12,13). Each of the couplers (121,131) includesatubularportion (121A,131A) which has two opposite open ends (121B,131B) for insertion of apairof the adjoining ends (1201,1301) of theupper and lower frame sections (120,130), and a socket portion (122, 132) which projects from the tubular portion (121A,131A) between the open ends (121B,131B) and which has a socket hole (122H,132H). Each of the vertical posts 15 has two ends 150 respectively supported by the socket portion (122, 132) of a corresponding one of the couplers 121 in the upper frame 12 and the socket portion 132 of a corresponding one of the couplers 131 in the lower frame 13. The lower frame 13 preferably has a brace member 135 connected at opposite ends to the lower frame sections 130.

As to the construction of the couplers (121,131), a detailed description of the same can be found in the aforesaid co-pending U.S. patent application, the entire disclosure of which is incorporated therein by reference.

A flexible enclosure 11, which has a depth in the vertical direction greater than that of the cot 20, is mounted on the upper and lower frames 12,13 and the vertical posts 15 in such a manner that the enclosure 11 is disposed around the cot 20. The enclosure 11 has an annular wall 110 with an open top, and a bottom support 14 mounted on and supported by the brace member 135 of the lower frame 13 inside the enclosure 11. The enclosure 11 further has a plurality of upright retention sleeves 111 on an outer circumferential surface of the annular wall 110 to permit passage of the upright posts 15 therethrough such that the annular wall 110 is prevented from shrinking inwardly relative to the upper and lower frames 12,13.

When the playpen of this invention is used to accommodate a small child, the cot 20 is installed to facilitate putting and taking of the child from the playpen. When the child has outgrown the cot 20, the cot 20 can be removed from the upper frame 12 so that the child can play in the enclosure 11. The object of this invention is thus met.

With this invention thus explained, it is apparent that numerous modifications and variations can be made without departing from the scope and spirit of this invention. It is therefore intended that this invention be limited only as indicated in the appended claims.

I claim:

1. A playpen comprising:

a looped lower frame;

a looped upper frame disposed above and spaced apart from said lower frame in a vertical direction;

a plurality of vertical posts bridging said upper and lower frames;

a cot having a bottom wall and a surrounding wall that is connected to a periphery of said bottom wall and that extends upwardly from said bottom wall, said surrounding wall having a length in the vertical direction which is shorter than a distance between said upper and lower frames in the vertical direction, said surrounding wall further having a distal top portion that engages removably said upper frame for suspending said cot thereon such that said bottom wall is disposed above said lower frame; and a releasable fastening unit, provided on said distal top portion of said surrounding wall and said vertical posts, for fastening releasably said cot on said vertical posts.

2. The playpen as defined in claim 1, wherein said distal top portion of said surrounding wall is formed from a fabric material, and has an outwardly folded section defining a looped receiving groove that opens downward for receiving removably said upper frame therein.

3. The playpen as defined in claim 2, wherein said outwardly folded section is provided with a plurality of notches that are registered with said vertical posts, said releasable fastening unit including complementary male and female fastener sets, one of said male and female fastener sets being secured to said vertical posts, the other one of said male and female fastener sets being secured to said outwardly folded section and extending into said notches such that each fastener of said one of said male and female fastener sets is disposed between a pair of fasteners of the other one of said male and female fastener sets.

4. The playpen as defined in claim 3, wherein each of said fasteners of said one of said male and female fastener sets is formed with a coupling ring, each of said vertical posts being provided with an anchoring strap that is connected to said coupling ring of a respective one of said fasteners of said one of said male and female fastener sets.

5. The playpen as defined in claim 3, wherein:

each of said fasteners of said female fastener set includes a hollow fastener body with an open insert end, and a confining wall that is formed with opposite engaging slots; and each of said fasteners of said male fastener set has an insert portion that is extended into said hollow fastener body of a corresponding one of said fasteners of said female fastener set via said open insert end and that is formed with resilient projections for engaging releasably said engaging slots in said hollow fastener body of the corresponding one of said fasteners of said female fastener set.

6. The playpen as defined in claim 3, wherein said cot further has a plurality of elastic bands, each of said elastic bands being secured to said outwardly folded section and extending between an adjacent pair of said notches, each of said elastic bands having opposite ends connected to a respective two of said fasteners of the other one of said male and female fastener sets, whereby said elastic bands ensure tight engagement between said distal top portion of said surrounding wall and said upper frame when said male and female fastener sets are interengaged.

7. The playpen as defined in claim 1, wherein said lower frame includes a plurality of interconnected lower frame sections having adjoining ends, and said upper frame includes a plurality of interconnected upper frame sections having adjoining ends.

8. The playpen as defined in claim 7, further comprising a plurality of couplers interconnecting said adjoining ends of said upper and lower frame sections.

9. The playpen as defined in claim 8, wherein each of said couplers includes a tubular portion which has two opposite open ends for insertion of a pair of said adjoining ends of said upper and lower frame sections, and a socket portion which projects from said tubular portion between said open ends and which has a socket hole, each of said vertical posts having two ends respectively supported by said socket portion of a corresponding one of said couplers in said upper frame and said socket portion of a corresponding one of said couplers in said lower frame.

10. The playpen as defined in claim 1, further comprising a flexible enclosure which is mounted on said upper and lower frames and said vertical posts and which has an annular wall with an open top, and a bottom support mounted on said lower frame inside said enclosure.

* * * * *